US008368606B1

(12) United States Patent
Haugan

(10) Patent No.: US 8,368,606 B1
(45) Date of Patent: Feb. 5, 2013

(54) TRAILER MOUNTED SATELLITE SYSTEM

(76) Inventor: Jon Haugan, Clovis, CA (US)

( * ) Notice: Subject to any disclaimer, the term of this patent is extended or adjusted under 35 U.S.C. 154(b) by 0 days.

(21) Appl. No.: 12/748,009

(22) Filed: Mar. 26, 2010

(51) Int. Cl.
*H01Q 1/32* (2006.01)

(52) U.S. Cl. ..... 343/713; 343/880; 343/912; 343/878

(58) Field of Classification Search ..... 343/711, 343/712, 713, 878, 880, 912
See application file for complete search history.

(56) References Cited

U.S. PATENT DOCUMENTS

| | | | | |
|---|---|---|---|---|
| 4,185,288 | A * | 1/1980 | Dosch et al. | 343/765 |
| 4,309,708 | A * | 1/1982 | Sayovitz | 343/713 |
| 4,856,838 | A | 8/1989 | Reshke et al. | |
| 5,337,062 | A | 8/1994 | Sherwood et al. | |
| 5,414,435 | A * | 5/1995 | Wolf | 343/713 |
| 5,554,998 | A | 9/1996 | Sherwood et al. | |
| 5,897,158 | A | 4/1999 | Henke et al. | |
| 6,209,939 | B1 | 4/2001 | Wacker | |
| 6,422,628 | B1 | 7/2002 | Bortell | |
| 6,497,442 | B1 | 12/2002 | Wacker | |
| 6,783,164 | B2 | 8/2004 | Bortell | |
| 2008/0055170 | A1 | 3/2008 | Madden, Jr. et al. | |

FOREIGN PATENT DOCUMENTS

| | | |
|---|---|---|
| DE | 1836937 | 8/1961 |
| DE | 4126979 A1 | 2/1993 |
| EP | 0370314 A2 | 5/1990 |

* cited by examiner

*Primary Examiner* — Dieu H Duong
(74) *Attorney, Agent, or Firm* — Richard A. Ryan

(57) ABSTRACT

An improved mobile satellite communication system comprises an antenna configured to transmit and receive signals from a satellite and a modem connected to a mast to generate a wireless WiFi zone around the system to allow persons within the zone to access the Internet and communicate via wireless telephones and fax machines. The system comprises a lightweight, relatively small sized trailer having electronic cases containing the necessary electronics and storage cabinets containing other equipment and materials. Front and rear stabilizing mechanisms extend outward from the trailer to stabilize the system when in use. A collapsible or foldable tow bar is provided for transporting the system with a vehicle. The antenna is mounted on a support structure above the electronic cases and supported by the cabinets. Preferably, the satellite system is sized and configured to be transported by conventional, smaller sized helicopters and to be relatively inexpensive to manufacture.

20 Claims, 7 Drawing Sheets

TRAILER MOUNTED SATELLITE SYSTEM

CROSS-REFERENCE TO RELATED APPLICATIONS

None.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The field of the present invention relates generally to mobile satellite systems that can be transported over land and by helicopter or other aircraft. In particular, the present invention relates to such systems that are configured to be easily and quickly moved to a desired location and sufficiently rugged for use in a wide variety of different and/or extreme environments. Even more particularly, the present invention relates to such systems that comprise one or more dish antennas, masts, various electronic and electrical systems, ruggedized storage containers and other accessories desirable for use to transmit and receive satellite and other electronic signals.

B. Background

Modern communication systems commonly utilize one or more dish or dish-type antennas for transmitting and receiving microwave signals between a ground-based location and one or more communications satellites orbiting the Earth. Such systems are also utilized to transmit and receive such signals to and from an aircraft or other airborne communication unit. Most such communication systems comprise a generally parabolic-shaped antenna reflector to collect the electronic signals transmitted from an airborne satellite or other source and direct the signals to an antenna feed, which houses the electronics that transmit and receive the microwave signals, positioned at the focal point of the antenna reflector by an antenna feed boom extending outward from the base of the reflector. Typically, the antenna reflector and associated components are supported on the ground or attached to the structure utilizing a pedestal or other rigid structural support. The use and general configuration of such systems are well known in the art.

Communications systems also commonly utilize masts to support a variety of operational objects, including antennas, cameras or the like, above the ground or other surface to which the mast is mounted so the operational object may perform its tasks. The typical mast is an integral structure that provides a platform for the operational object at a set distance above the mounting surface. While such masts are sufficient for many purposes, often it is desired to have a mast that is telescopically configured so the mast may be extended to allow the operational object to accomplish its operational objectives and then lowered so the mast may be stored or moved to a different location. Even if a mast is fixedly mounted to the support surface, there are times when it is desirable to lower the mast to protect it and/or the operational object from wind or inclement weather, attack or other incidents or to allow the structure to which the mast is attached to move from one location to another with less risk of damage to the mast and/or the operational object attached thereto. The use and configuration of such masts are generally well known to those skilled in the art.

Most communications systems utilizing dish antennas and/or masts have the antenna or mast fixedly installed on the ground or to a building, tower or other stationary structure such that the antenna and/or mast are only utilized at a particular site or location to transmit or receive electronic communication signals from one or more satellites as they pass overhead. Such stationary location systems are configured to maintain the parabolic shape of the antenna reflector in order to minimize the loss of signal or distortion in transmission or reception of the electronic signals. In addition, stationary locations have the ability to provide the various electronic and electrical equipment that are necessary to support and power the communication system. For instance, the communication system must be capable of allowing the antenna to remain focused on the satellite or other communication source or target in order to maintain effective transmission and reception of microwave signals to and from the antenna. This typically requires the antenna dish to be rigidly mounted to the ground or the structure in order to minimize movement of the antenna reflector due to wind or other external loads or motion.

As well known by those skilled in the art, it is often desirable to be able to move the communication system from a location where it is being used or stored to a location where it is needed and then to a new location or back to storage. One particular need for a mobile communication system is for use as part of a response to an emergency situation. For instance, natural disasters such as hurricanes, tornadoes, earthquakes, floods, fires and the like can entirely disable or otherwise render inoperable any local communication networks at a time when effective and reliable communication is perhaps most needed. As well known, emergency rescue and other response personnel are likely to need access to modern communications, including telephone and Internet connections, to assist them while responding to the natural disaster. In particular, law enforcement units, medical personnel and related responders need to be able to communicate with persons in their chain of command and with others who may be able to assist them with dealing with the emergency. Persons who are living in or otherwise occupying the area would also benefit from the availability of a mobile communication system that allows them to utilize their cellular phones and/or computers. Mobile communication systems can also be extremely beneficial for persons located in a war zone or those who are responding to a localized conflict, including riots and other disturbances. The communication systems in war zones or areas of civil disturbances are often non-existent or, if they do exist, are usually not reliable and subject to interruption by opposing forces or those involved in the civil disturbance.

Although the benefits of having a mobile communication system is known and considered to be very necessary, the present availability of these communication systems for use during natural disasters, disturbances or other emergencies is somewhat limited. One reason for the lack of readily available mobile communication systems is that their arrangement and use generally presents a significant technical challenge. Most mobile communication systems, which are often used for mobile television broadcasting of live news casts, sporting events, concerts and the like, generally have the antenna reflector and the supporting equipment mounted in or to a very large transport vehicle. Some of these systems have the antenna mounted directly onto the bed of a truck or trailer or mounted to the roof of a trailer which encloses the various supporting equipment necessary to operate the communication system. In either type of configuration, the supporting vehicle is typically quite large and, as a result, only able to move from one location to another over land on a road or other relatively smooth, driveable surface. As well known to those who respond to natural disasters and/or disturbances, however, access to the subject area is often not obtainable or at least not easily or quickly obtainable on a road. This reduces the usefulness of the typical mobile communication system for responding to natural or other emergencies. In order for a mobile communication system to be useful and effective during an emergency requiring immediate telephone and Internet availability to the responders and others in an area where such services are no longer available, the mobile communication system needs to be able to be transported by helicopter or other aircraft.

Transporting a communication system by helicopter and using the system in an area that was impacted by a natural disaster or disturbance, which may be ongoing, presents its own challenges. For instance, the communication system must be configured so as to be easily liftable by a helicopter, which requires the total weight of the system to be kept to a minimum. In addition, the fact that the system is raised off the ground, transported by helicopter and then lowered back onto the ground subjects the mobile communication system to a significant amount of vibration and other forces. If the system is not properly configured, these forces can destroy the antenna, mast, electronic equipment and/or the various other supporting equipment necessary to operate the communication equipment and provide the desired telephone and Internet services. In particular, various forces can be transmitted through the supporting frame of the structure to the antenna reflector, antenna feed and electronic equipment (such as amplifiers, decoders and the like) that can render these components inoperable. Some prior art mobile communication systems have frame-mounted electronics cabinets that house integrated electronics racks which are mounted to the interior of the electronics cabinets. Unfortunately, any jarring or vibrations forces that are imparted to the vehicle chassis during transportation or during use are readily transferred to the electronic components, which may be damaged or destroyed by such forces. The need for the system to be relatively lightweight is generally counterproductive to the need to prevent damage due to vibration and other forces.

Much of modern communications is achieved through a wireless connection to a location having a modem which is electronically connected to a source of communications. For mobile communication systems, the source of the communications is one or more orbiting satellites. The modem connects to the satellite via the parabolic-shaped antenna reflector and its related communication equipment. The modem essentially creates a wireless Internet connection zone that allows persons to connect to the Internet and communicate by wireless telephones (via Voice over Internet Protocol or VOIC). Such a system allows persons located inside the wireless zone to communicate with others.

What is needed, therefore, is an improved mobile communication system that comprises the various components and equipment needed to transmit and receive microwave signals to and from one or more communication satellites and which can be easily and readily moved from one location to another over land or by helicopter. In addition to being easily moved, the satellite communication system must be configured to prevent damage to the antenna reflector, antenna feed and other electronic components during transportation and use of the system. Preferably, the satellite communication system should be configured with a relatively small trailer or like mobile platform that can be pulled behind a vehicle or, as desired or necessary, airlifted by a helicopter or other aircraft. In a preferred configuration, the satellite communication system should include a mast that supports a modem and/or other electronic devices which are necessary to create a wireless communication zone in an area around the system in which persons may connect to the Internet and utilize wireless telephones. The preferred satellite communication system should be configured so that it can substantially, on its own, provide all the required communication and electronic equipment to provide wireless Internet and telephone communications.

SUMMARY OF THE INVENTION

The trailer mounted satellite system of the present invention provides the benefits and solves the problems identified above. That is to say, the present invention discloses an improved mobile satellite communication system which comprises the components and equipment needed to transmit and receive microwave signals to and from a satellite to establish a wireless zone for Internet and telephone communications and which can be easily and readily moved from one location to another over land or by helicopter. The satellite system of the present invention comprises all the communication and electronic equipment that are necessary and beneficial for establishing a wireless zone around the system in order to provide wireless Internet and telephone communications to persons operating in that zone. The trailer mounted satellite system of the present invention is configured to prevent damage to the antenna reflector, antenna feed and other electronic components during transportation, whether by land or air, and use of the system. In a preferred embodiment, the satellite system of the present invention has a relatively small trailer or similarly configured mobile platform that can be towed by a vehicle or, as desired or necessary, airlifted by a helicopter or other aircraft. The preferred configuration of the present satellite system comprises a mast that supports a modem and/or other electronic devices which are necessary to create the wireless communication zone around the system so that emergency responders and other persons may connect to the Internet and utilize wireless telephones to communicate with each other and with persons outside the area.

In a preferred embodiment of the present invention, the trailer mounted satellite system generally comprises a trailer, front and rear stabilizing mechanisms associated with the trailer, one or more electronic cases on the trailer, one or more storage cabinets on the trailer, an antenna support structure supported by the trailer, an antenna on the support structure to communicate with a satellite and a mast operatively connected to a modem to generate a WiFi zone around the trailer for wireless connection to the Internet and communication by telephone or fax machine. The trailer has a frame having a plurality of frame members that support a floor which defines an upwardly disposed surface and two or more wheels that are rotatably supported by the frame. In a preferred embodiment, the front stabilizing mechanism is at the front or first end of the trailer and the rear stabilizing mechanism is at the back or second end of the trailer. Each of the front and rear stabilizing mechanisms have a support arm that is attached at its proximal end to the trailer and a support jack that is attached to the distal end of the support arm. The front and rear stabilizing mechanisms are configured to move between an extended stabilizing position during use and a collapsed or retracted position for transport or storage. The electronic cases are on or above the upwardly disposed surface, preferably separated therefrom by a cushioned mount that is configured to reduce the transmission of vibration and other forces to the electronic cases. Preferably, the electronic cases are of the type that are commonly known as military grade to safely enclose the electronic components used by the antenna and modem so as to reduce vibration and other forces and prevent the entry of dust, dirt, water and other materials that are likely to damage the electronic components. In a preferred configuration, the storage cabinets on the trailer are positioned above the upwardly disposed surface by one or more riser supports to provide storage space under the cabinets. The antenna support structure, having a plurality of support frame members, supports the antenna generally above and in spaced apart relation to the electronic cases to further reduce vibration and other forces. In the preferred embodiment, the opposite end of the antenna support structure is supported by the cabinets. The mast is attached to a mast mount on the trailer, preferably the floor thereof. The mast is configured to be removed or pivoted downward for transport and storage and/or to telescopically extend and retract as needed. The antenna is also configured to move between a collapsed position for transport and storage and an operational position during use. The antenna transmits and receives satellite signals and the modem generates a WiFi zone to allow wireless communication generally around the satellite system. In the preferred embodiment, the various components of the satellite system are selected so the satellite system weighs less than approximately 1,800 pounds and does not exceed approximately five feet wide by eight feet long during transport and storage thereof so that it may be lifted and moved to the desired location by conventional, smaller sized helicopters for lower cost and increased availability.

Accordingly, the primary aspect of the present invention is to provide a trailer mounted satellite system that has the advantages discussed above and which overcomes the disadvantages and limitations associated with prior art mobile satellite systems.

It is an important aspect of the present invention to provide a trailer mounted satellite system that can be easy moved to a desired location by land and air and which comprises all of the communication and electronic components that are necessary to establish a wireless zone around the system to allow persons within that zone to wirelessly connect to the Internet and to utilize wireless telephones to communicate with each other and persons and systems outside the zone.

It is also an important aspect of the present invention to provide a trailer mounted satellite system that can be transported to a area where needed by being towed behind another vehicle or by air using a helicopter or other aircraft.

It is also an important aspect of the present invention to provide a trailer mounted satellite system that can be transported by smaller sized, conventional civilian/military helicopters operated by one person (i.e., not the large military or heavy lift helicopters).

It is also an important aspect of the present invention to provide a trailer mounted satellite system that is easily mobile and configured to prevent damage to electronic and communications equipment from vibration and other forces while being moved by land or air.

It is also an important aspect of the present invention to provide a trailer mounted satellite system that comprises a trailer and communications support equipment that are selected so the system is moveable by helicopter to allow a wireless Internet and telephone communication system to be placed in an area not accessible or easily accessible by ground transport so responders and others may communicate to each other and persons outside the area.

Another important aspect of the present invention is to provide a trailer mounted satellite system that comprises a mast having a modem mounted thereto or configured therewith to establish a wireless zone around the system for persons to wirelessly communicate by Internet or telephone.

The above and other aspects and advantages of the present invention are explained in greater detail by reference to the attached figures and the description of the preferred embodiment which follows. As set forth herein, the present invention resides in the novel features of form, construction, mode of operation and combination of the above presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed text and drawings are merely illustrative of one or more preferred embodiments and, as such, disclose one or more different ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the figures and description provided herein show a certain configuration for the trailer, antenna and mast, those skilled in the art will readily understand that this is merely for purposes of simplifying this disclosure and that the present invention is not so limited.

Figure 6:
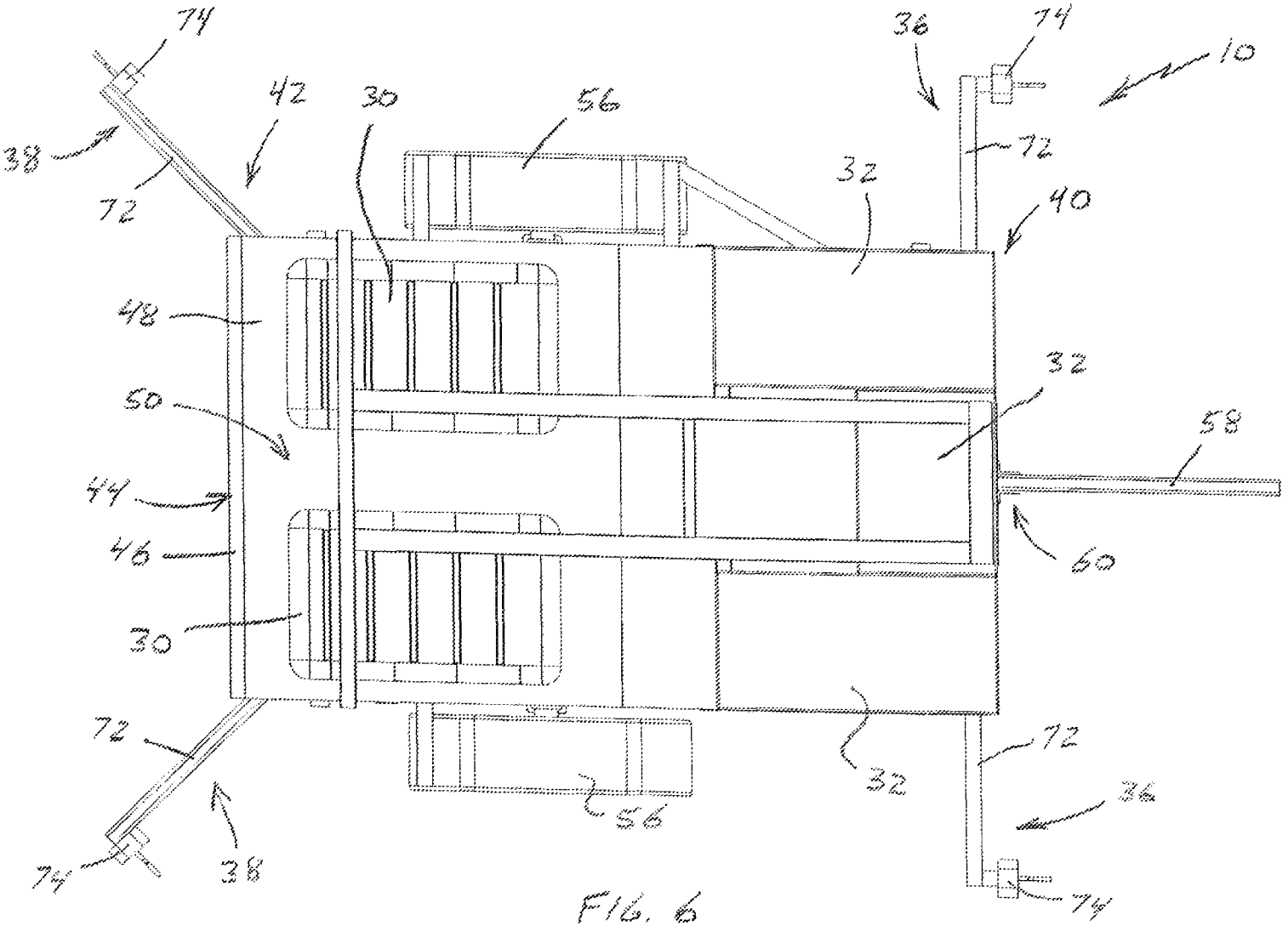
FIG. 6 is a top view of the trailer mounted satellite system of FIG. 1.
Figure 7:
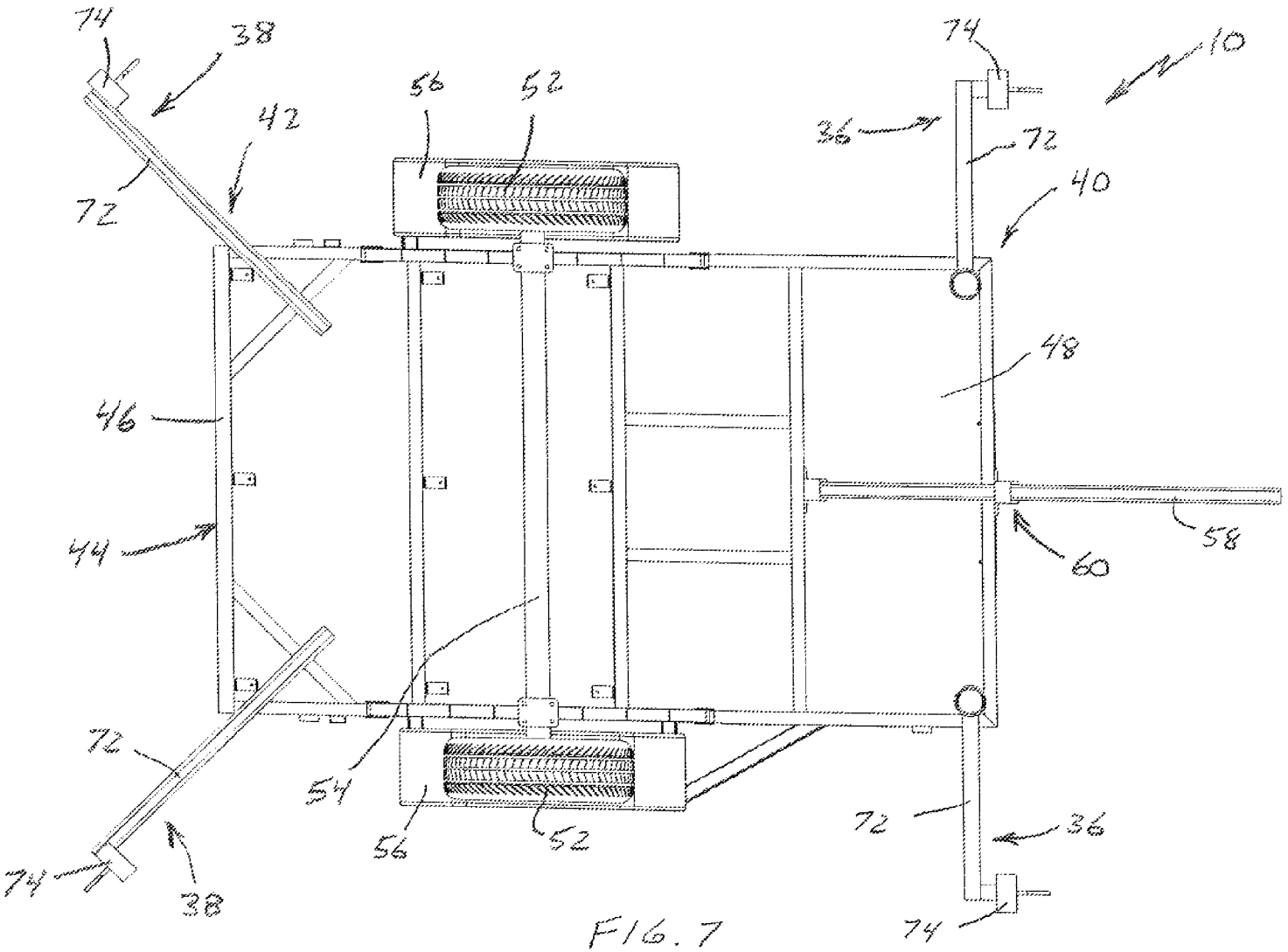
FIG. 7 is a bottom view of the trailer mounted satellite system of FIG. 1.
Figure 8:
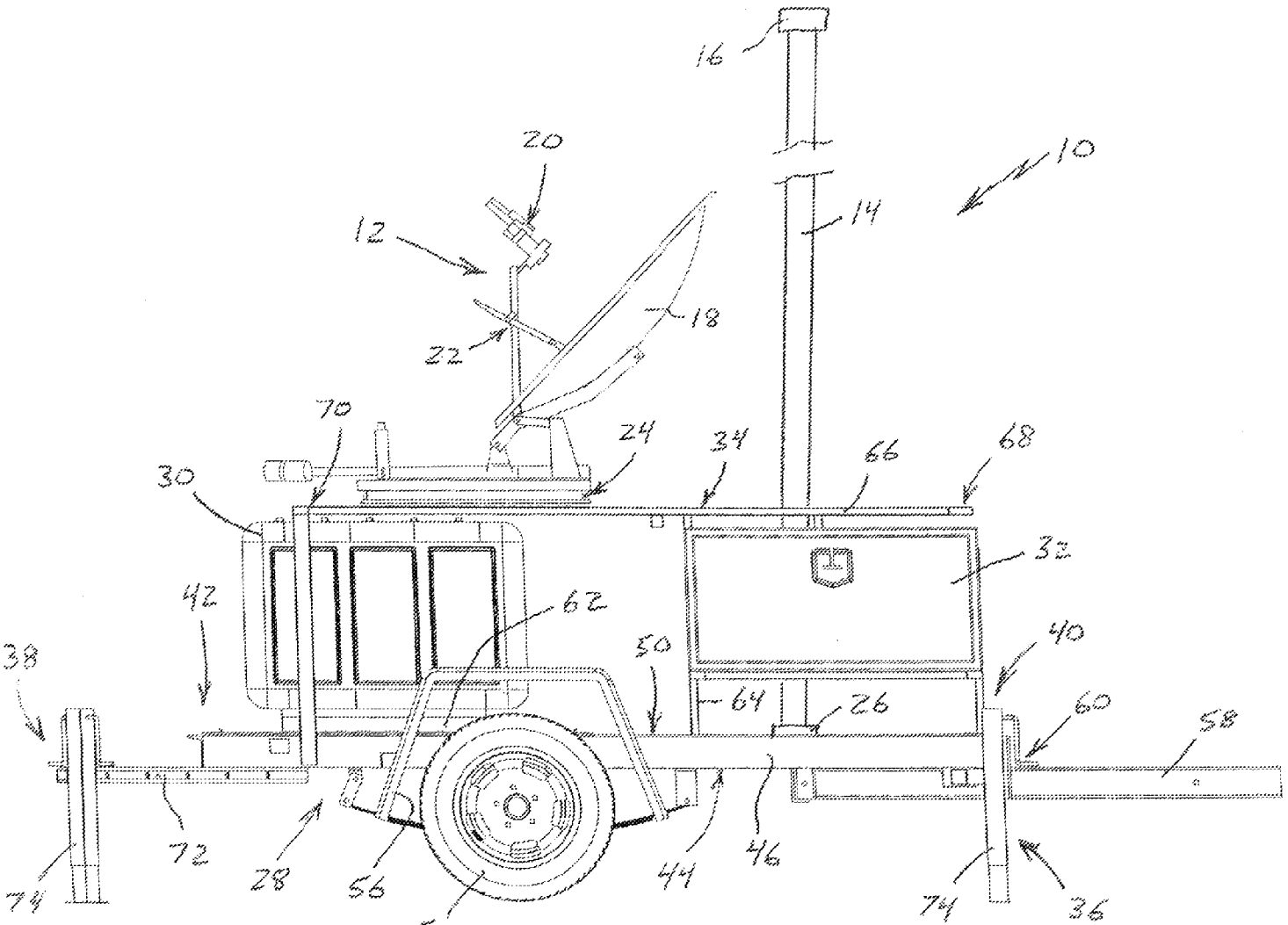
FIG. 8 is a right side view of the trailer mounted satellite system of FIG. 1 shown with a mast and an antenna mounted thereon.

A trailer mounted satellite system that is configured pursuant to a preferred embodiment of the present invention is shown generally as 10 in FIGS. 1 through 8. As set forth in more detail below, the trailer mounted satellite system 10 is configured to be portable and to structurally and operationally support an antenna 12 for transmitting microwave signals from and to a satellite, a mast 14 that supports a modem 16 and various communication components, equipment and devices that are utilized with the antenna 12, mast 14 and modem 16, as shown in FIG. 8. The satellite system 10 of the present invention is utilized to establish an area around the satellite system 10 where responders and other persons in the established area can wirelessly communicate with each other and persons outside the area through the Internet and wireless telephone, which will typically be achieved using VOIP or the like. In one embodiment, the satellite system 10 of the present invention is utilized to assist those who are responding to a natural disaster, such as hurricanes, tornadoes, earthquakes, floods, fires and the like or in a conflict zone, such as a war, major riots or large civil disturbances. Unfortunately, these types of events can result in significant damage to or even loss of conventional communication systems. As well known in the art, persons responding to the event or persons who reside or are otherwise in such an area are very much in need of reliable communication between each other and to persons located outside the area, including commanders, supervising personnel, medical experts and the like. As set forth in more detail below, the satellite system 10 of the present invention can be quickly moved into an area that has experienced or is experiencing a natural disaster or conflict to provide the desired and necessary communications ability.

The satellite system 10 can utilize a wide variety of different types of antennas 12, masts 14, modems 16 and other communication components and equipment to accomplish the communications objectives of the present invention. Persons skilled in the art will readily understand that the antenna 12, mast 14 and modem 16 shown in FIG. 8 are included for exemplary purposes only and the present invention is not so limited. The typical antenna 12 comprises a generally parabolic-shaped antenna reflector 18 to collect the electronic signals transmitted from a satellite and direct the signals to an antenna feed 20, which houses the various electronics that transmit and receive the microwave signals, positioned at the focal point of the antenna reflector 18 by an antenna feed boom 22 that extends outward from the antenna reflector 18, as shown in FIG. 8. An antenna base 24 supports, typically rotatably, the antenna 12 on the satellite system 10 of the present invention. In a preferred embodiment, the antenna 12 is of the type that is collapsible or foldable so that it can be placed in its collapsed/folded position to safely and efficiently allow movement of the satellite system 10 into and out of an area where the ability to connect to the Internet and have wireless telephone communication is needed. Such antennas are well known in the art, as exemplified by U.S. Pat. Nos. 5,337,062 and 5,554,998 to Sherwood (the disclosure of each of these patents is hereby incorporated by reference as though fully set forth herein).

As stated above, a variety of masts 14 and modems 16 can be utilized with the satellite system 10 of the present invention. In one embodiment, shown in FIG. 8, mast 14 is of the type having a fixed length to place the modem 16 at a specific height above the ground or other surface on which the satellite system 10 is being utilized. In an alternative embodiment, the mast 14 can be of the type that is telescoping to allow the user to extend the mast 14 when the satellite system 10 is in use and retract the mast 14 when not in use or when it is being transported or stored. For either configuration, the preferred embodiment of the satellite system 10 utilizes a mast 14 that removably mounts to a mast mount 26 that is fixedly attached to the trailer 28, described in more detail below. The mast mount 26 can be of the type that allows the user to easily and quickly attach or remove the mast 14 from the trailer 28 as it is needed for the modem 16. In this embodiment, the mast 14 can be stored in a pipe, such as a PVC pipe or the like, on trailer 28 when not in use. Alternatively, the mast mount 26 can be of the type that allows the mast 14, whether of a fixed length or telescopically configured, to pivot downward when not in use. Mast mounts 26 such as those described above are generally well known in the art for securing masts, flag poles and the like to a surface.

The modem 16 is of the type that is used to generate a wireless field or zone around the satellite system 10 so that emergency responders or other persons working or otherwise in the wireless zone who have computers (typically laptop computers), cellular telephones and/or fax machines can wirelessly interact with the modem 16. In a preferred embodiment, the modem 16 is of the type that creates a WiFi network around the satellite system 10. The modem 16 is electronically connected to antenna 12 such that the person having the computer or telephone can then connect through the modem 16 to the antenna 12 and then to the satellite, which will then allow that person to communicate through the Internet to other persons in the wireless zone and to persons or data located outside the wireless zone. As is well known to those skilled in the art, the strength of the wireless signal and the size of the wireless zone created by the modem 16 is dependent on a number of factors, including the type and size of the antenna 12.

Figure 1:
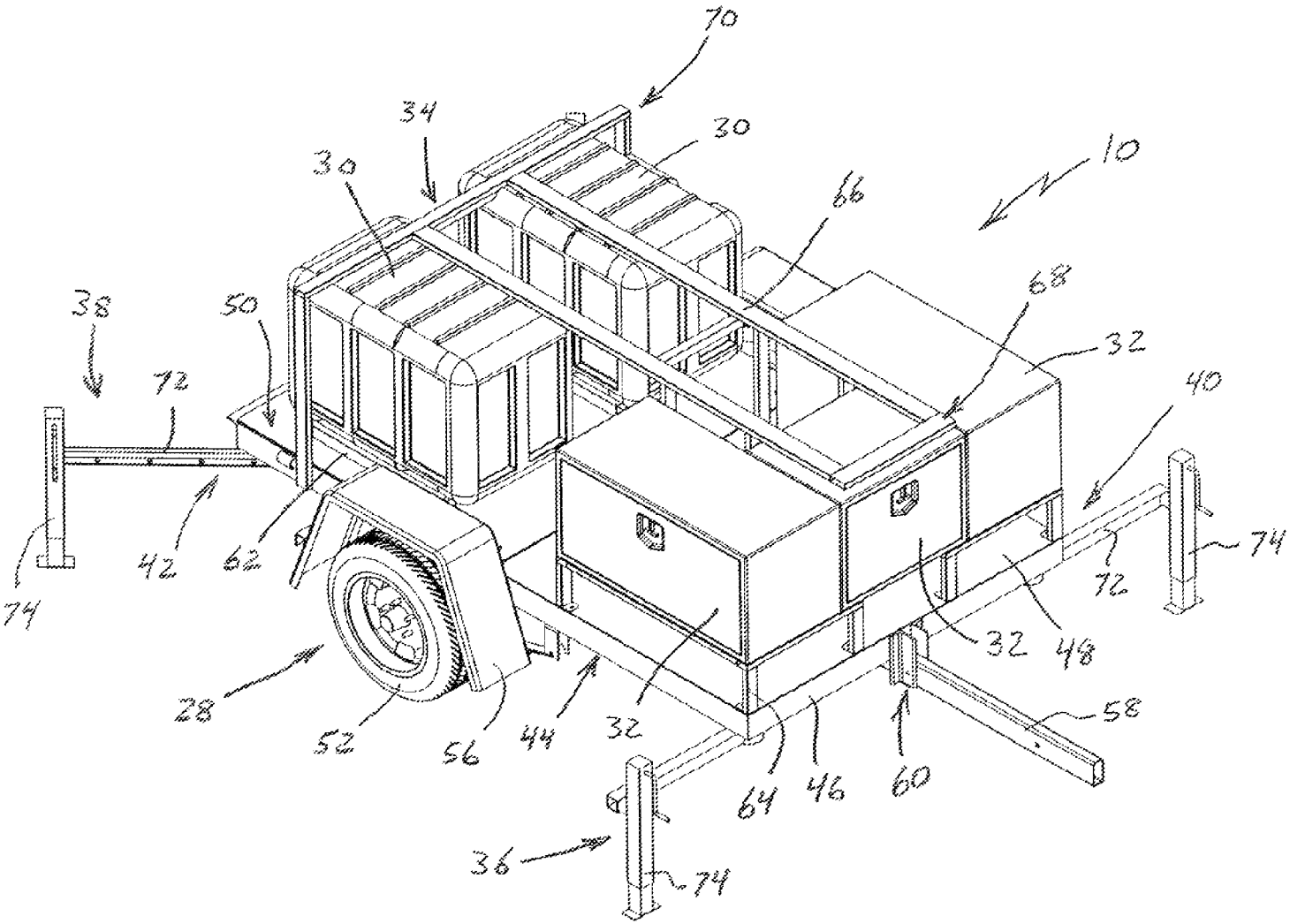
FIG. 1 is a top perspective view of a trailer mounted satellite system configured according to a preferred embodiment of the present invention shown with the front and rear stabilizing mechanisms extended and tow bar lowered.
Figure 2:
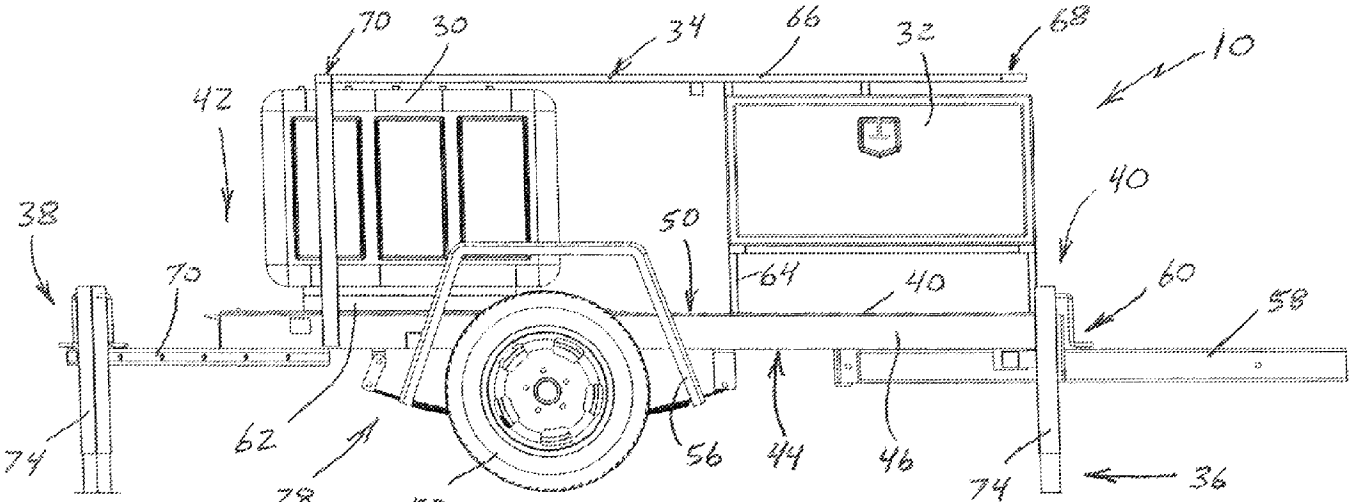
FIG. 2 is a right side view of the trailer mounted satellite system of FIG. 1.
Figure 3:
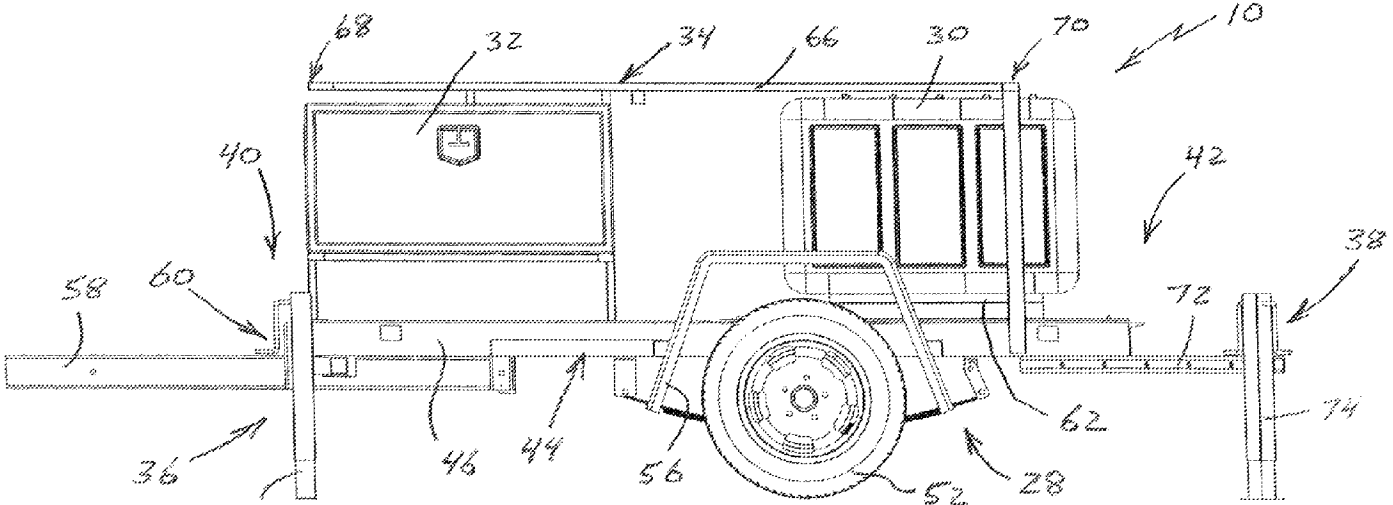
FIG. 3 is a left side view of the trailer mounted satellite system of FIG. 1.
Figure 4:
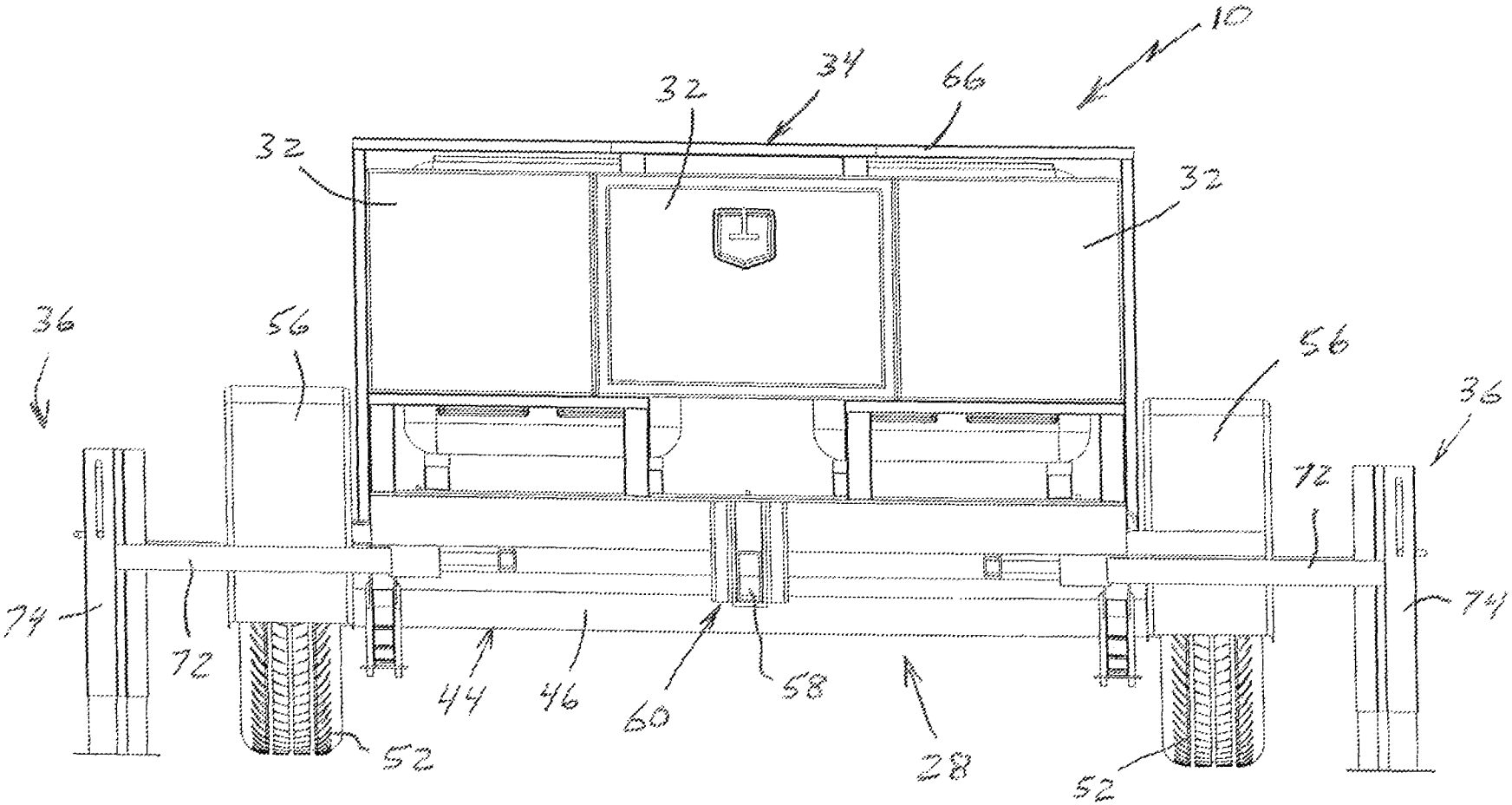
FIG. 4 is a front view of the trailer mounted satellite system of FIG. 1.
Figure 5:
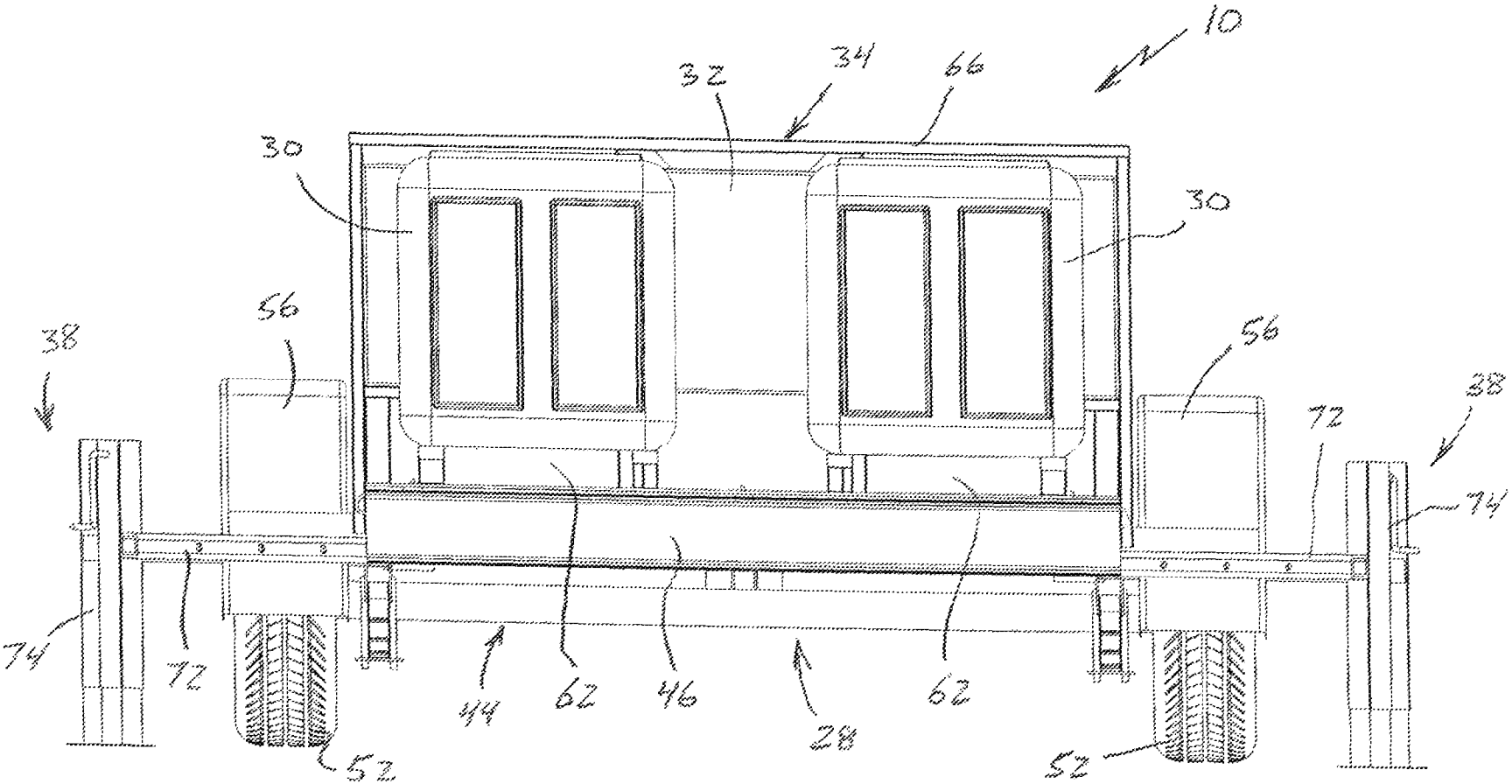
FIG. 5 is a back view of the trailer mounted satellite system of FIG. 1.

The satellite system 10 of the present invention primarily comprises the trailer 28, one or more electronic cases 30, one or more storage cabinets 32, an antenna support structure 34, a front stabilizing mechanism 36 and a rear stabilizing mechanism 38, as shown in FIGS. 1 through 8. The electronic cases 30, cabinets 32 and antenna support structure 34 are supported on the trailer 28 and the front 36 and rear 38 stabilizing mechanisms, which are located at the front or first end 40 and the back or second end 42, respectively, of the trailer 28 are utilized to stabilize trailer 28 during use. The trailer 28 comprises a frame 44 having a plurality of frame members 46 that support the trailer floor 48 which defines an upwardly disposed floor surface 50, as best shown in FIGS. 2 and 3, above or on which the electronic cases 30, cabinets 32 and antenna support structure 34 are positioned. In a preferred embodiment, the trailer 28 has a pair of wheels 52 that are rotatably mounted on an axle 54 supported by the frame 44, as best shown in FIG. 7. Preferably, each of the wheels 52 are covered by a splash guard 56 to prevent or at least reduce the likelihood that water, dirt, mud or other materials will be splashed onto the components above the floor 48 of trailer 28. The trailer 28 also has an attached tongue or tow bar 58 for use when towing the satellite system 10 behind a motor vehicle, such as a car, truck, jeep, RV or the like. In a preferred embodiment, tow bar 58 is pivotally attached to frame 44 by bar pivoting mechanism 60, best shown in FIGS. 1 through 3, that allows the user to pivot the tow bar 58 upward when being used to tow trailer 28, particularly when the satellite system 10 is being carried by a helicopter or other aircraft. If desired, tow bar 58 can be configured to be collapsible or otherwise disassembled to reduce the interference thereof during transport or use of the satellite system 10. In one embodiment, the tow bar 58 is configured to extend or collapse relative to the first end 40 of trailer 28. As well known in the art, the trailer 28 needs to be provided with a suspension system that is configured to minimize the amount of vibration and other forces on the various communication and electronic components of satellite system 10 during transport, particularly when being transported over a road and when lowered onto the ground by a helicopter. The use and configuration of such suspension systems are generally well known in the art.

The electronic cases 30 are configured to safely store and allow access, preferably limited access, to the various electronic components that are needed and utilized with the antenna 12, such as computer servers and the like. Because these components are somewhat sensitive to vibration and other forces and to contamination by dirt, dust, water and other such potentially damaging materials, the electronic cases need to be configured to at least substantially reduce or prevent any vibration and other forces from being transmitted to the electronic components and prevent any such contaminates from entering the cases so as to prevent damage to the electronic components. Preferably, the electronic cases 30 can be removed from trailer 28 as required or beneficial and the cases are configured such that the components inside are substantially inaccessible to unauthorized persons so these persons cannot accidently or intentionally damage the electronic components, which would likely render the communication system of satellite system 10 inoperable. In the preferred embodiment, the electronic cases 30 are selected from commercially available cases, such as those from Hardigg Industries or the like. The use of such cases 30 are generally well known in the art and are frequently utilized to store and transport military and other sophisticated equipment. In the preferred embodiment, the cases 30 have a cushioned mount 62 that separates the cases 30 from the floor 48 of trailer 28, as best shown in FIGS. 1 through 3, and act as a shock absorber to reduce the transmission of any vibrations or other forces to the electronic cases 30. The use of cushioned mounts 62, including shock absorbers and shock absorbing material, are generally well known in the art of transporting vibration sensitive materials.

The storage cabinets 32 are provided and utilized to store equipment and materials that are necessary or useful for using and/or transporting the satellite system 10 of the present invention. Unlike electronic cases 30, the cabinets 32 are not configured to store and transport sensitive electronic components and, therefore, do not require the same level of sophistication and protection as the electronic cases 30. In one embodiment, storage cabinets 30 are made out of metal, preferably relatively lightweight metals such as aluminum or the like, to reduce the weight contribution thereof. If desired, the cabinets 30 can be made out of various non-metal materials, including carbon fiber, plastic, fiberglass or the like or combinations thereof. As shown, the storage cabinets 32 have handle mechanisms that allow the user to pivot or otherwise open the door of the storage cabinet 32 for access to the equipment and materials, such as tools, wire and the like, stored therein. Preferably, storage cabinets 32 can be locked to prevent unauthorized access to the interior thereof and to reduce the likelihood of accidental opening during transport or use. In the preferred embodiment, storage cabinets 32 are supported in spaced apart relation to the surface 50 of floor 48 by a plurality of riser supports 64, best shown in FIGS. 2 and 3, to provide storage space below the cabinets 32 that can be utilized to store other materials or equipment that is necessary or useful for operating or transporting satellite system 10.

As shown in FIG. 8, the antenna 12 is mounted on antenna support structure 34. In a preferred embodiment, antenna support structure 34 comprises a plurality of support frame members 66 that define a generally lightweight, open support structure 34 having a first end 68 toward the first end 36 of trailer 28 and a second end 70 toward the second end 38 of trailer 28 for supporting antenna 12 in spaced apart relation to the surface 50 of floor 48 and above the electronic cases 30 and storage cabinets 32. In a preferred embodiment, shown in the figures, the second end 70 of antenna support structure 34 is disposed in spaced apart relation to the upper surface of the electronic cases 30 such that none of the weight from the antenna 12 is in contact with or supported by the electronic cases 30 to prevent the weight thereof from damaging the electronic cases 30, particularly during transport of satellite system 10. Instead, as shown, the second end 70 of the antenna support structure 34 above the electronic cases 30 is supported directly by the frame 44. If desired, the second end 70 of antenna support structure 34 may be connected to and supported by floor 48, which is supported by frame 44. In the preferred embodiment, antenna support structure 34 is supported at or near the first end 68 thereof by storage cabinets 32 (as best shown in FIGS. 2 and 3), which in turn are supported above the trailer 28 by riser supports 64. Supporting the first end 68 of the antenna support structure 34 with storage cabinets 32 has the benefit of reducing the weight of satellite system 10, which is particularly important for enabling transport by conventional smaller sized civilian or military helicopters that can be operated by one person, as opposed to the larger sized civilian or military heavy lift helicopters requiring multiple operators. In addition, the use of conventional helicopters significantly reduces the cost of transporting satellite system 10 and substantially increases the likelihood that such transport will be readily available.

The preferred embodiment of satellite system 10 of the present invention has a front stabilizing mechanism 36 at or near the first end 40 of trailer 28 and a rear stabilizing mechanism 38 at or near the second end 43 of trailer 28 that are configured to stabilize trailer 28 during use of the antenna 12, mast 14 and other communication equipment that are mounted thereon. In a preferred configuration, each of the front stabilizing mechanism 36 and the rear stabilizing mechanism 38 have a pair of outwardly extending support arms 72 that connect at their proximal end at or near the first end 40 and second end 42, respectively, of trailer 28, as best shown in FIGS. 1, 6 and 7. Located at the distal end of each of the support arms 72 is support jack 74 that is configured to extend to contact the ground or other surface and stabilize the trailer 28 and retract when not in use (i.e, when being transported or in storage). The support arms 72 are configured to collapse or pivot toward trailer 28 to reduce the size and profile of satellite system 10 when being transported or stored. Alternatively, the support arms 72 can be configured to be removably attached to trailer 28 so the user of satellite system 10 can attach the support arms 72 when needed for support and remove them for transport or storage. In the embodiment shown in the figures, support arms 72 at the first end 40 of trailer 28 extend laterally from trailer 28 and the support arms 72 at the second end 42 of trailer 28 extend at an angle relative to the trailer 28, as best shown in FIGS. 6 and 7. In the preferred embodiment, support jacks 74 are fixedly attached to the support arms 72. Support jacks 74 can be manually operated by a hand crank mechanism (as shown) and/or hydraulically, electrically or pneumatically powered to raise and lower the extendable portion thereof as needed to contact the ground or other surface on which satellite system 10 is positioned. The configuration and use of support jacks 74 are generally well known to persons skilled in the art. In the preferred embodiment, each of the support jacks 74 are configured the same so as to reduce the expense of satellite system 10 and provide a more uniform operation thereof.

In an alternative embodiment, the satellite system 10 of the present invention also includes a pair or outriggers that are pivotally attached to the sides of frame 44 to provide additional support to trailer 28 during use of the satellite system 10 (i.e., with the antenna 12 folded up and mast 14 in its upright position). The outriggers would help stabilize the trailer 28 in windy conditions and/or in the event of vibration or other forces. Typically, the outriggers will comprise a pair of arms that form a generally triangular shape with a support jack at the distal ends of the arms that can be lowered to contact the ground when needed and raised when the outriggers are not in use. Preferably, the outriggers are configured to pivot against the side of the frame 44 during transport and storage of satellite system 10 to reduce the size and profile of the satellite system 10.

In the preferred embodiment, the various structural components of satellite system 10 are made out of strong but relatively lightweight materials, such as steel and aluminum, to reduce the overall weight and cost of the satellite system. Alternatively, various other lightweight materials, including plastic, fiberglass, carbon fiber and the like, or combinations thereof, are used to reduce the weight of satellite system 10. Preferably, the satellite system 10 of the present invention is sized and configured to be airlifted by a conventional, smaller sized helicopter, such as those commonly utilized in commercial aviation (as opposed to the larger sized heavy lift helicopters used in commercial and military operations). As well known, the use of smaller sized, conventional helicopters significantly reduces the cost of transporting satellite system 10 due to lower fuel use, personnel (typically only one person is necessary to operate such helicopters) and other operating costs. In addition, such helicopters are usually more available, particularly with short notice. Presently, available mobile satellite systems require the use of larger helicopters. Although the satellite system 10 of the present invention can be moved with larger helicopters, the smaller size of the system 10 greatly increases the flexibility with regard to available aircraft. The satellite system 10 of the present invention is preferably sized and configured to be approximately five feet wide by approximately eight feet long in its collapsed condition and weight less than approximately 1,800 pounds. Such size and weight makes the satellite system 10 able to be moved by smaller, conventional helicopters.

In use, the satellite system 10 is configured with the trailer 28, electronic cases 30, storage cabinets 32, antenna support structure 34 and other components described above. The antenna 12, which is preferably of the automated type, is mounted onto the antenna support structure 34 and placed in its collapsed position during transport and storage. Also during transport and storage, the mast 14 is either removed from mast mount 26 and inserted into a tubular mast storage device, placed in its collapsed position or pivoted down onto or near the surface 50 of floor 48. The various electronic components necessary to operate the antenna 12 and generate the WiFi wireless communication zone from modem 16 are stored in the electronic cases 30. The other equipment and materials are stored in cabinets 32. During transport and storage, the front 36 and rear 38 stabilizing mechanisms (as well as the outrigger apparatuses if they are utilized) are collapsed inward, pivoted against the frame 44 or otherwise reduced in size to result in satellite system 10 having a relatively small profile that is compact and easily portable. As well known in the art, antenna 12 is chosen for the desired size of the wireless zone created by modem 16. For instance, a 0.96 meter antenna reflector 18 will provide a wireless zone of approximately five miles and a 1.2 meter antenna reflector 18 will provide a wireless zone of approximately ten miles. Preferably, "off-the-shelf" components are chosen to reduce costs. After the satellite system 10 is transported to its desired location, the front 36 and rear 38 stabilizing mechanisms are placed in their extended use positions and the jacks 74 are operated to lower the movable component thereof onto the ground or other surface to stabilize the trailer 28. The various electronic and electrical components are connected to a source of electricity, typically a portable generator or the like, the antenna 12 is placed in operating position and the mast 14 is raised, typically to a height of approximately forty feet, to provide the desired positioning for modem 16. The various electronic and electrical systems are then activated to connect the antenna 12 to a satellite and generate the WiFi wireless zone around satellite system 10. Once setup, users within the wireless zone will be able to access the Internet and communicate over wireless telephones and fax machines.

While there are shown and described herein a specific form of the invention, it will be readily apparent to those skilled in the art that the invention is not so limited, but is susceptible to various modifications and rearrangements in design and materials without departing from the spirit and scope of the invention. In particular, it should be noted that the present invention is subject to various modifications with regard to any dimensional relationships set forth herein, with regard to its assembly, size, shape and use and with regard to the materials used in its construction. For instance, there are a number of components described herein that can be replaced with equivalent functioning components to accomplish the objectives of the present invention.

What is claimed is:

1. A satellite system, comprising:

a trailer having a frame supporting a floor defining an upwardly disposed surface;

a front stabilizing mechanism at a first end of said trailer;

a rear stabilizing mechanism at a second end of said trailer;

one or more electronic cases on said trailer on or above said upwardly disposed surface;

one or more storage cabinets on said trailer on or above said upwardly disposed surface;

an antenna support structure on said trailer configured to support an antenna, said antenna support structure configured to support said antenna generally above said one or more electronic cases;

a mast attached to said trailer; and a modem operatively connected to said mast, wherein said antenna is configured to transmit and receive satellite signals and said modem is configured to allow wireless communication generally around said satellite system.

2. The satellite system of claim 1, wherein said trailer has one or more wheels rotatably attached to said frame.

3. The satellite system of claim 1, wherein each of said front stabilizing mechanism and said rear stabilizing mechanism comprise a support arm attached to said trailer and a support jack attached to said support arm.

4. The satellite system of claim 1 further comprising a cushioned mount for each of said electronic cases, said cushioned mount configured to reduce transmission of vibration and other forces to said electronic cases.

5. The satellite system of claim 4, wherein said cushioned mount is disposed between each of said electronic cases and said upwardly disposed surface.

6. The satellite system of claim 1, wherein said cabinets are positioned in spaced apart relation above said upwardly disposed surface by one or more riser supports.

7. The satellite system of claim 1 further comprising a mast mount mounting said mast to said upwardly disposed surface.

8. The satellite system of claim 1, wherein said storage cabinets are at or near said first end of said trailer, a first end of said antenna support structure is supported by said storage cabinets and a second end of said antenna support structure is in spaced apart relation to said electronic cases.

9. The satellite system of claim 8, wherein said second end of said antenna support structure is attached to one or more frame members of said frame.

10. The satellite system of claim 1, wherein said satellite system weighs less than approximately 1,800 pounds.

11. The satellite system of claim 1, wherein said satellite system does not exceed approximately five feet wide by eight feet long during transport and storage thereof.

12. A satellite system, comprising:

a trailer having a frame supporting a floor defining an upwardly disposed surface and two or more wheels rotatably supported by said frame;

a front stabilizing mechanism at a first end of said trailer and a rear stabilizing mechanism at a second end of said trailer, each of said front stabilizing mechanism and said rear stabilizing mechanism having a support arm attached to said trailer and a support jack attached to said support arm;

a tow bar at said first end of said trailer;

one or more electronic cases on said trailer on or above said upwardly disposed surface;

one or more storage cabinets on said trailer on or above said upwardly disposed surface;

an antenna support structure on said trailer configured to support an antenna, said antenna support structure having a plurality of support frame members configured to support said antenna generally above and in spaced apart relation to said one or more electronic cases;

a mast attached to a mast mount on said trailer; and a modem operatively connected to said mast, wherein said antenna is configured to transmit and receive satellite signals and said modem is configured to allow wireless communication generally around said satellite system.

13. The satellite system of claim 12 further comprising a cushioned mount for each of said electronic cases, said cushioned mount configured to reduce transmission of vibration and other forces to said electronic cases.

14. The satellite system of claim 13, wherein said cushioned mount is disposed between each of said electronic cases and said upwardly disposed surface.

15. The satellite system of claim 12, wherein said cabinets are positioned in spaced apart relation above said upwardly disposed surface by one or more riser supports.

16. The satellite system of claim 12, wherein said storage cabinets are at or near said first end of said trailer, a first end of said antenna support structure is supported by said storage cabinets and a second end of said antenna support structure is attached to one or more frame members of said frame.

17. The satellite system of claim 12, wherein said satellite system weighs less than approximately 1,800 pounds and does not exceed dimensions of approximately five feet wide by eight feet long during transport and storage thereof.

18. A satellite system, comprising:

a trailer having a frame supporting a floor defining an upwardly disposed surface and two or more wheels rotatably supported by said frame;

a front stabilizing mechanism at a first end of said trailer and a rear stabilizing mechanism at a second end of said trailer, each of said front stabilizing mechanism and said rear stabilizing mechanism having a support arm attached to said trailer and a support jack attached to said support arm;

one or more electronic cases on said trailer on or above said upwardly disposed surface;

a cushioned mount for each of said electronic cases, said cushioned mount configured to reduce transmission of vibration and other forces to said electronic cases;

one or more storage cabinets on said trailer on or above said upwardly disposed surface, said cabinets positioned in spaced apart relation above said upwardly disposed surface by one or more riser supports;

an antenna support structure on said trailer configured to support an antenna, said antenna support structure having a plurality of support frame members configured to support said antenna generally above and in spaced apart relation to said one or more electronic cases;

a mast attached to a mast mount on said trailer; and a modem operatively connected to said mast, wherein said antenna is configured to transmit and receive satellite signals and said modem is configured to allow wireless communication generally around said satellite system.

19. The satellite system of claim 18, wherein said storage cabinets are at or near said first end of said trailer, a first end of said antenna support structure is supported by said storage cabinets and a second end of said antenna support structure is attached to one or more frame members of said frame.

20. The satellite system of claim 18, wherein said satellite system weighs less than approximately 1,800 pounds and does not exceed dimensions of approximately five feet wide by eight feet long during transport and storage thereof.

* * * * *